US008382502B2

(12) United States Patent
Cao et al.

(10) Patent No.: US 8,382,502 B2
(45) Date of Patent: Feb. 26, 2013

(54) ILLUMINATION DEVICE WITH A CONNECTOR HAVING A RETAINER WITH A ROTARY MEMBER AND A STARTER AND A SWICH AND ELASTIC PIECES

(75) Inventors: Qing-Shan Cao, Shenzhen (CN); Yu Hu, Shenzhen (CN); Jian-Pu Chen, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/301,805

(22) Filed: Nov. 22, 2011

(65) Prior Publication Data

US 2013/0003365 A1 Jan. 3, 2013

(30) Foreign Application Priority Data

Jun. 29, 2011 (CN) ..... 2011 1 0178468

(51) Int. Cl.
*H01R 33/02* (2006.01)
*F21V 1/00* (2006.01)
*F21V 21/00* (2006.01)

(52) U.S. Cl. ..... 439/226; 362/217.01; 362/217.14; 362/240

(58) Field of Classification Search ..... 439/226, 439/13; 362/228, 254, 394, 217.14, 240, 362/217.01

See application file for complete search history.

(56) References Cited

U.S. PATENT DOCUMENTS

| | | | | |
|---|---|---|---|---|
| 6,113,408 | A * | 9/2000 | Burwell et al. | 439/226 |
| 6,193,534 | B1 * | 2/2001 | Burwell et al. | 439/226 |
| 7,556,396 | B2 * | 7/2009 | Kuo et al. | 362/217.01 |
| 7,927,154 | B2 * | 4/2011 | Sekela et al. | 439/699.2 |
| 8,297,788 | B2 * | 10/2012 | Bishop | 362/249.02 |
| 2006/0126325 | A1 * | 6/2006 | Lefebvre et al. | 362/217 |
| 2009/0122543 | A1 * | 5/2009 | Kuo et al. | 362/240 |
| 2010/0148673 | A1 * | 6/2010 | Stewart et al. | 315/121 |
| 2011/0010019 | A1 * | 1/2011 | Shloush et al. | 700/295 |
| 2011/0188238 | A1 * | 8/2011 | Cao et al. | 362/217.14 |
| 2011/0286225 | A1 * | 11/2011 | Konishi et al. | 362/398 |
| 2012/0051037 | A1 * | 3/2012 | Lin et al. | 362/217.14 |

* cited by examiner

*Primary Examiner* — Chandrika Prasad
(74) *Attorney, Agent, or Firm* — Altis Law Group, Inc.

(57) ABSTRACT

An illumination device includes a light tube holder including two connectors for receiving either a light-emitting diode (LED) tube or a fluorescent tube. The connector includes three conductive elastic pieces therein. One elastic piece is electrically connected to an LED tube drive circuit board and a fluorescent tube, and the other two elastic pieces are respectively electrically connected to the LED and fluorescent tube drive circuit boards. A normally closed switch is located in the one of the connectors. The switch has a first end connected between a power supply and a first end of a ballast, and a second end connected to a second end of the ballast. When the LED tube is mounted to the holder, the switch is closed, and when the fluorescent tube is mounted to the holder the switch is open.

6 Claims, 5 Drawing Sheets

ILLUMINATION DEVICE WITH A CONNECTOR HAVING A RETAINER WITH A ROTARY MEMBER AND A STARTER AND A SWICH AND ELASTIC PIECES

CROSS-REFERENCES TO RELATED APPLICATIONS

Related subject matter is disclosed in U.S. patent applications with Ser. No. 13/301,797 and a title of LIGHT TUBE HOLDER, Ser. No. 13/301,799 and a title of ILLUMINATION DEVICE, Ser. No. 13/301,800 and a title of ILLUMINATION DEVICE, Ser. No. 13/301,801 and a title of ILLUMINATION DEVICE, Ser. No. 13/301,808 and a title of ILLUMINATION DEVICE, and Ser. No. 13/301,810 and a title of ILLUMINATION DEVICE, which have the same assignees as the current application and were concurrently filed.

BACKGROUND

1. Technical Field

The present disclosure relates to illumination devices, and particularly, to a light-emitting diode (LED) illumination device for adapting an LED tube and a fluorescent tube.

2. Description of the Related Art

Generally, a conventional light tube holder for fluorescent tubes can not be used with LED tubes. When attempting using an LED tube, the conventional light tube holder needs to be replaced. It is desired and useful if a light tube holder can adapt both fluorescent tubes and LED tubes.

Therefore, there is room for improvement within the art.

BRIEF DESCRIPTION OF THE DRAWINGS

The components in the drawings are not necessarily drawn to scale, the emphasis instead being placed upon clearly illustrating the principles of an illumination device. Moreover, in the drawings, like reference numerals designate corresponding parts throughout the several views.

DETAILED DESCRIPTION

Figure 1:
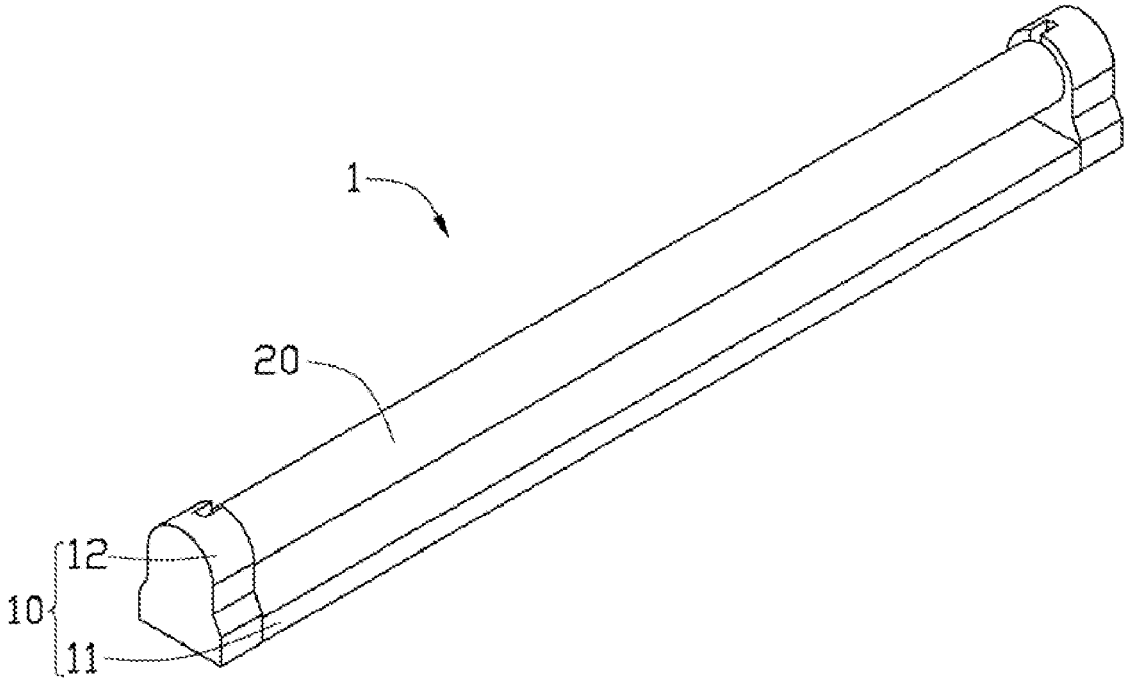
FIG. 1 is an isometric view of an illuminating device in accordance with an exemplary embodiment.
Figure 2:
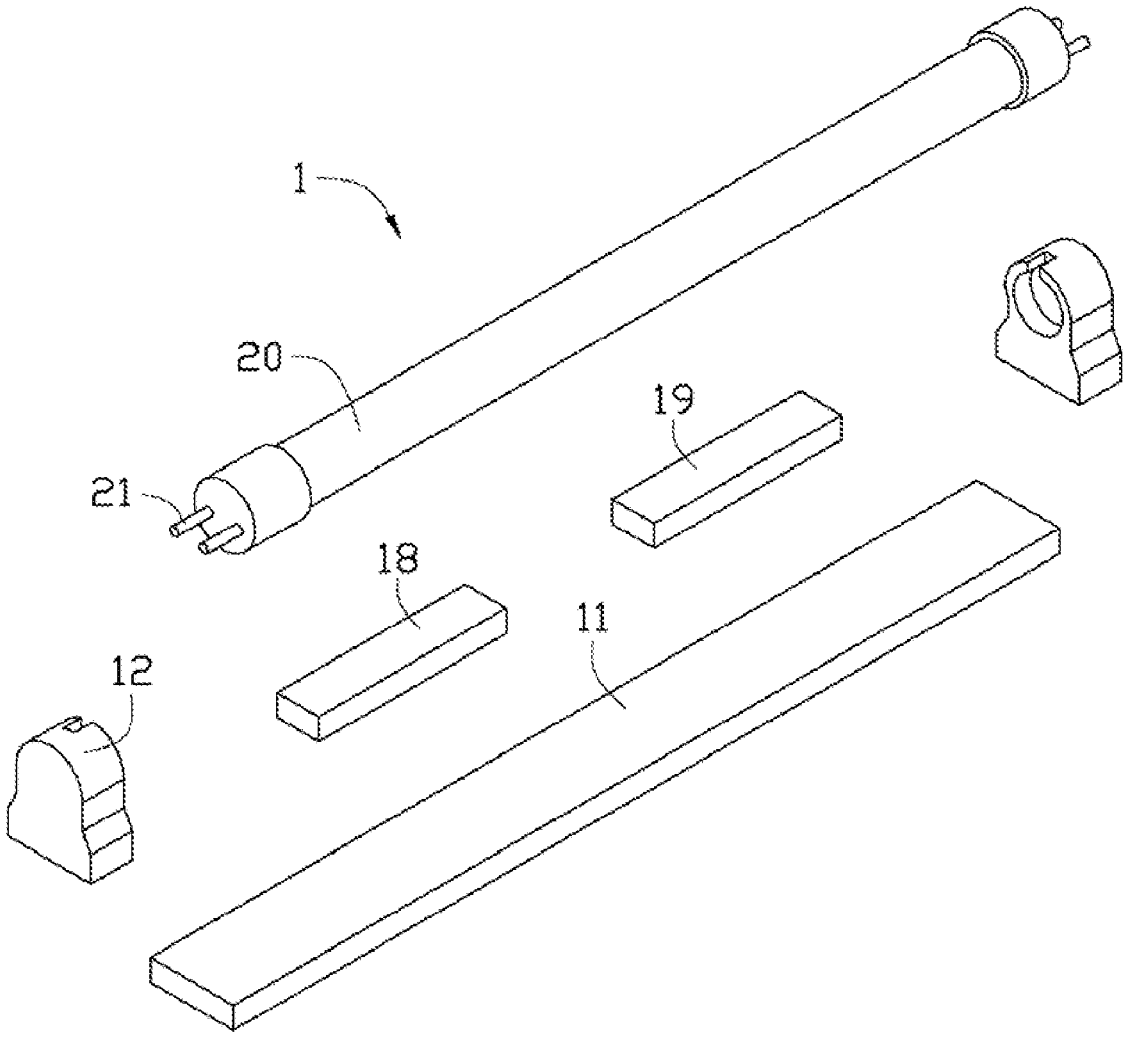
FIG. 2 is an explored view of the illuminating device in FIG. 1.
Figure 3:
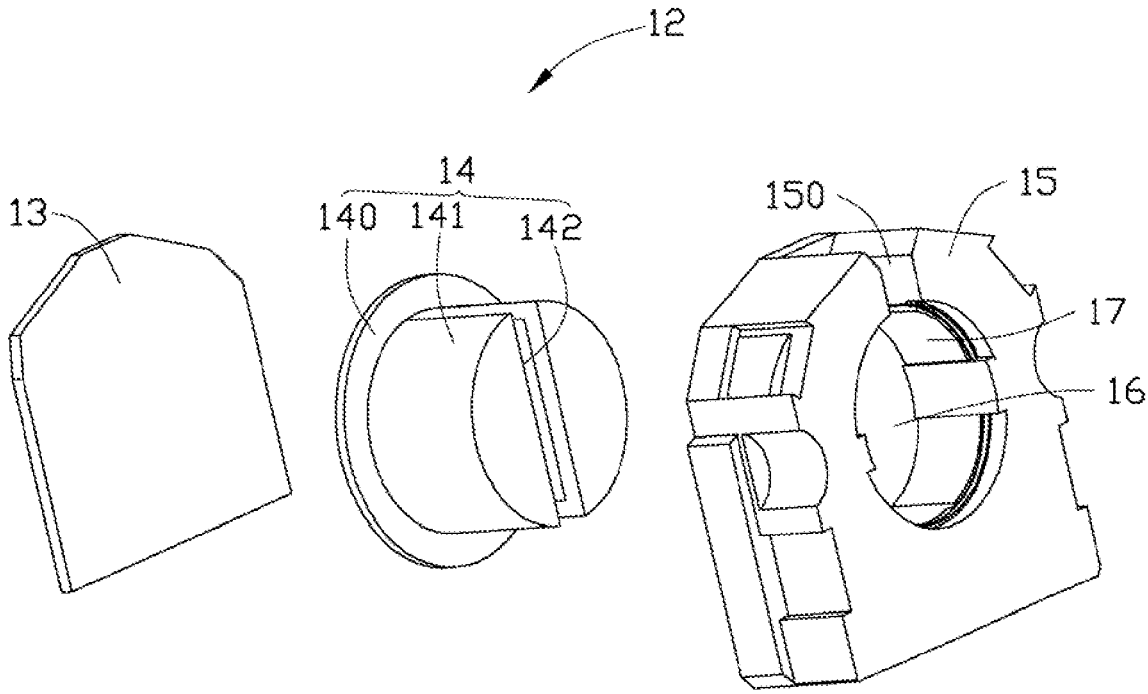
FIG. 3 is an explored view of a connector of the illuminating device in FIG. 1.

Referring to FIGS. 1-3, an illuminating device 1 includes a tube holder 10 and a tube 20 mounted on the tube holder 10. The tube 20 may be a traditional fluorescent tube or a light-emitting diode (LED) tube. The tube holder 10 can adapt a tube 20 in the both types. The fluorescent tube has two conductive pins on one end thereof and two conductive pins on an opposite end thereof, and the LED tube has one conductive pin and one insulating pin on one end thereof and one conductive pin and one insulating pin on an opposite end thereof. The tube holder 10 includes a base 11 and a pair of connectors 12 at opposite ends of the base 11. Each connector 12 includes a cap 13, a retainer 15, and a rotary member 14. The cap 13 is attached to one end of the retainer 15. The cap 13 and the retainer 15 cooperatively define a space to rotatably receive the rotary member 14 therein. In the embodiment, a through hole 16 is defined in the retainer 15. The rotary member 14 is smaller in diameter than the though hole 16, thereby allowing the rotary member 14 rotatably received in the through hole 16. The rotary member 14 is hat-shaped, including a brim 140, a body 141, and a first groove 142. The brim 140 is larger in diameter than the though hole 16, and abuts the outside end face of the retainer 15 around the though hole 16. The first groove 142 is defined in the middle of the body 141 extending long a diameter of the body 141, and divides the body 141 into two substantially equal parts. The first groove 142 can receive the two pins 21 of the tube 20 therein. An opening 150 is defined in the retainer 15 and extends from an external lateral surface to the sidewall of the through hole 16, and communicates with the though hole 16.

Figure 4:
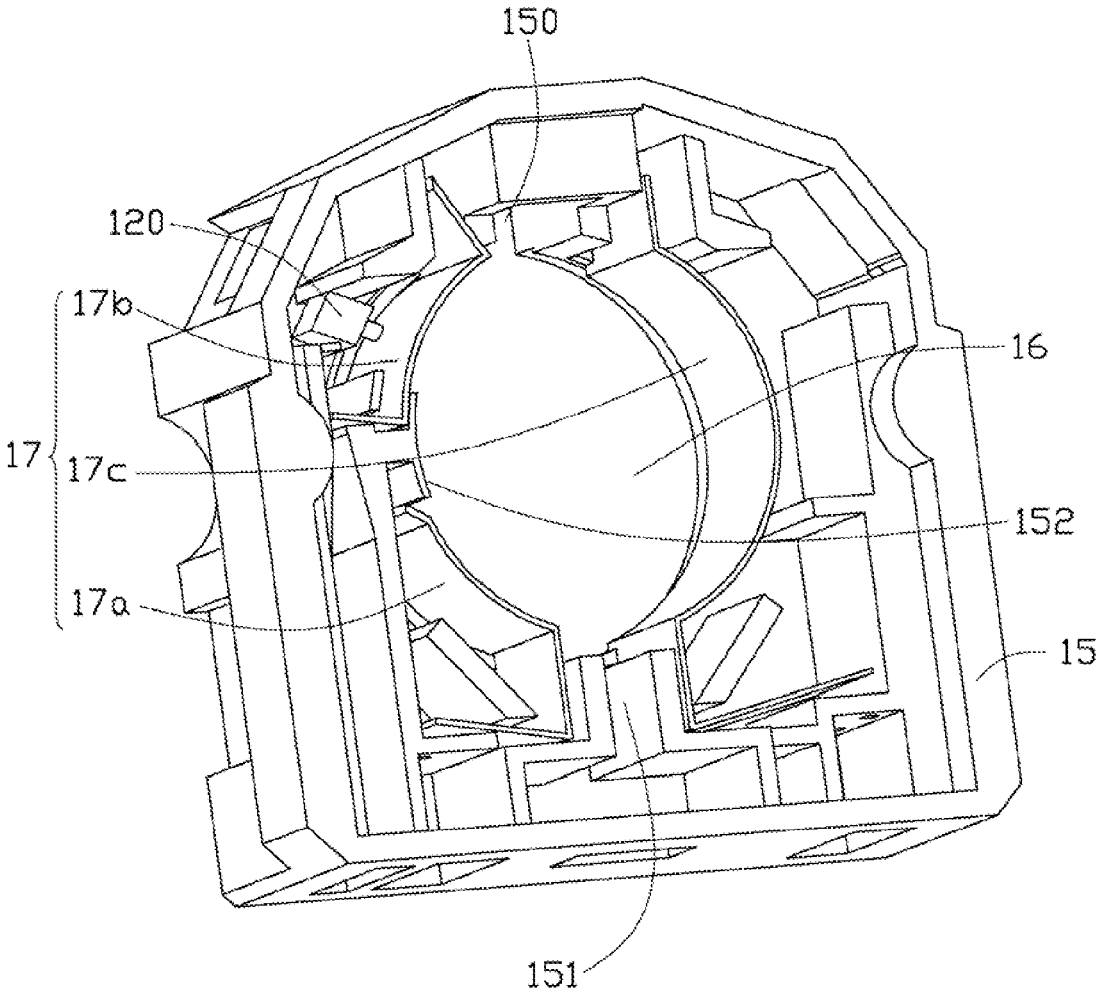
FIG. 4 is an isometric view of a retainer of the connector of the illuminating device in FIG. 3 according to a first exemplary embodiment.

Referring to FIG. 4, an elastic member 17 consisting of three elastic pieces 17*a*, 17*b*, 17*c* is positioned in the retainer 15 around the through hole 16. Each elastic piece 17*a*, 17*b*, 17*c* is made of an elastic metal sheet by stamping. The elastic piece 17*a* has a configuration of a half of a circle, while each of the elastic pieces 17*b*, 17*c* has a configuration of one fourth of a circle. A second groove 151 is defined in the retainer 15 opposite the opening 150. In this embodiment, at least one buffer pad 152 is formed on the side wall between the opening 150 and the second groove 151. The opening 150, the second groove 151, and the at least one buffer pad 152 are used to separate the three elastic pieces 17*a*, 17*b*, 17*c* of the elastic member 17 from each other. The three elastic pieces 17*a*, 17*b*, 17*c* of the elastic member 17 can then be electrically insulated from each other. The tube holder 10 further includes an LED tube drive circuit board 18 and a fluorescent tube drive circuit board 19 mounted in the base 11. The elastic pieces 17*a*, 17*c* are connected to the LED tube drive circuit board 18 and the elastic pieces 17*b*, 17*c* are connected to the fluorescent tube drive circuit board 19.

When installing the tube 20, the rotary member 14 is first rotated to cause the first groove 142 to align with the opening 150. The pins 21 of the tube 20 can then be inserted into the through hole 16 and supported in the first groove 142. The tube 20 can then be rotated to misalign the first groove 142 of the rotary member 14 with the opening 150, and securely retain the tube 20 in the retainer 15.

One of the connectors 12 further includes a switch 120 positioned between the edge of the retainer 15 and the elastic piece 17*b* which is connected to the fluorescent tube drive circuit board 19.

Figure 5:
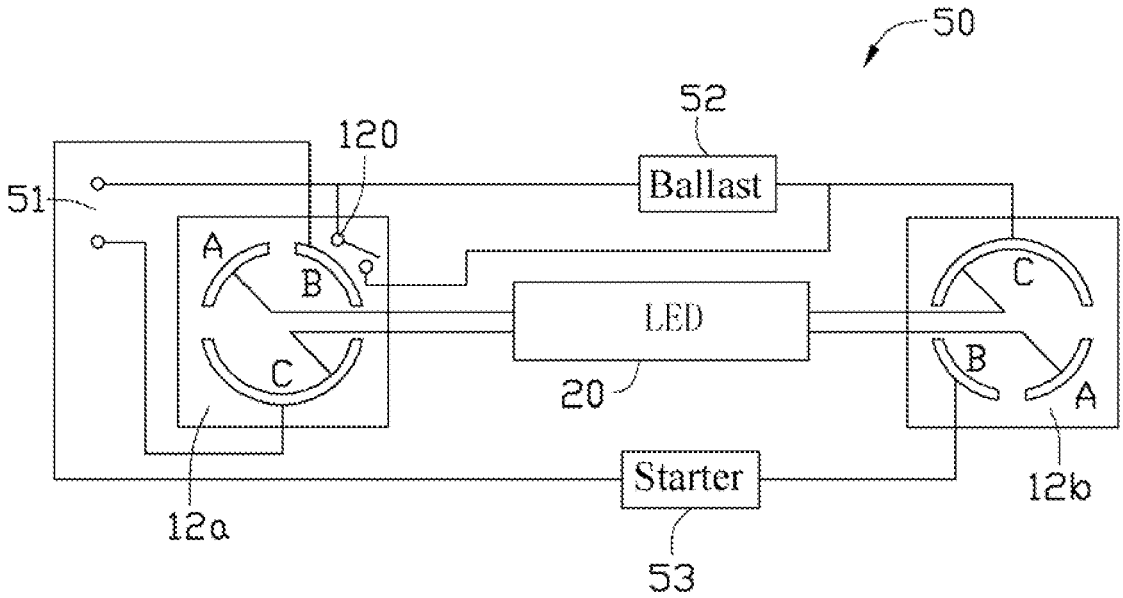
FIG. 5 is a circuit diagram of the illumination device with two connectors in FIG. 4 in accordance an exemplary embodiment.

FIG. 5 illustrates a drive circuit 50 of the illumination device 1 with two connectors 12 of FIG. 4 and an LED tube 20 connected thereto. To facilitate the description, the connector 12 at left of the drawing is termed as the connector 12*a*, while the connector 12 at right is termed as the connector 12*b*. The switch 120 is positioned in the left connector 12*a*. The elastic piece 17*c* of the connector 12*a* is connected to a negative terminal of a power supply 51. One end of the switch 120 and one end of a ballast 52 are connected to a positive terminal of the power supply 51, and the other end of the switch 120 is connected to the other end of the ballast 52, and then connected to the elastic piece 17*c* of the connector 12*b*. A starter 53 is connected between the elastic piece 17*b* of the connector 12*a* and the elastic piece 17*b* of the connector 12*b*. When the switch 120 is closed, the ballast 53 is bypassed. The switch 120 is normally closed.

When the tube 20 is an LED tube 20 and inserted into the connectors 12*a*, 12*b*, the insulating pins of the LED tube 20 are respectively connected with the elastic pieces 17*a* of the connectors 12*a*, 12*b*, and the conductive pins of the LED tube 20 are respectively connected with the elastic pieces 17*c* of the connectors 12*a*, 12*b*, as shown in FIG. 5. Electrical current from the power supply 51 flows through the switch 120, the elastic piece 17*c* of the connector 12*b*, the LED tube 20, the elastic piece 17*c* of the connector 12*a* back to the power supply 51. Thus, the LED tube 20 is driven by the LED tube drive circuit board 18 to illuminate.

When the tube 20 is a fluorescent tube 20, inserted into the connectors 12*a*, 12*b* and rotated to a predetermined position (indicated by a mark (not shown) on the connector 12*a*), the rotary member 14 is rotated to a first position where the pins 21 of the tube fluorescent 20 stay in contact with the elastic pieces 17*c*, 17*b* of the elastic member 17. The elastic piece 17*b* contacted with one pin 21 of the fluorescent tube 20 is pushed to be deformed and actuates the switch 120 to be opened. As a result, electrical current flows through the ballast 52, the fluorescent tube 20, the starter 53, the fluorescent tube 20 again and back to the power supply 51 thereby allowing the fluorescent tube 20 to be driven by the fluorescent tube drive circuit board 19 and illuminate. As a result, no matter what the type of the tube 20 is, the tube holder 10 can well adapt the tube 20.

In the first embodiment, the elastic member 17 includes three elastic pieces 17*a*, 17*b*, and 17*c*. The length of the elastic piece 17*c* is about 0.5A, where A represents the perimeter of the through hole 16. The lengths of the elastic pieces 17*a* and 17*b* are both 0.25A. The number of the at least one buffer pad 152 is one. Thus, the elastic pieces 17*a*, 17*b*, and 17*c* are separated from each other by the opening 150, the second groove 151 and the buffer pad 152.

It is understood that the present disclosure may be embodied in other forms without departing from the spirit thereof. Thus, the present examples and embodiments are to be considered in all respects as illustrative and not restrictive, and the disclosure is not to be limited to the details given herein.

What is claimed is:

1. An illumination device comprising:

a light tube holder comprising:

a base;

a drive circuit board mounted in the base and comprising a power supply, a ballast having one end connected to a positive terminal of the power supply, a light-emitting diode (LED) tube drive circuit board, and a fluorescent tube drive circuit board mounted in the base;

first and second connectors at opposite ends of the base for selectively receiving one of a fluorescent tube and an LED tube, the fluorescent tube comprising two conductive pins arranged on one end thereof and another two conductive pins arranged on an opposite end thereof, the LED tube comprising a conductive pin and an insulating pin at each of two opposite ends thereof;

wherein each of the first and second connectors comprises:

a retainer defining a though hole;

a rotary member rotatably received in the through hole, and defining a first groove to receive the two pins at on one end of one of the tubes;

first, second and third elastic pieces positioned in the retainer around the through hole, wherein the first and third elastic pieces are connected to the LED tube drive circuit board and the second and third elastic pieces are connected to the fluorescent tube drive circuit board;

a starter; and a switch positioned in the first connector and having one end connected to the positive terminal of the power supply and another end connected to an opposite end of the ballast, wherein the switch is normally closed to bypass the ballast;

wherein when the LED tube is mounted to the first and second connectors at a first position, the insulating pins of the LED tube are respectively connected to the first elastic pieces of the first and second connectors, the conductive pins of the LED tube are respectively connected to the third elastic pieces of the first and second connectors, the starter is connected between the second elastic pieces of the first and second connectors, the another end of the switch and the opposite end of the ballast are connected to the third elastic piece of the second connector and the third elastic piece of the first connector is connected to a negative terminal of the power supply; and wherein when the fluorescent tube is mounted to the first and second connectors at a second position different from the first position, the conductive pins of the fluorescent tube at one end thereof are respectively connected to the second and third elastic pieces of the first connector, the conductive pins at the other end of the fluorescent tube are respectively connected to the second and third elastic pieces of the second connector, the starter is connected between the second elastic pieces of the first and second connectors, the another end of the switch and the opposite end of the ballast are connected to the third elastic piece of the second connector, the third elastic piece of the first connector is connected to the negative terminal of the power supply, and the switch is open to cause electrical current from the positive terminal of the power supply to flow to the third elastic piece of the second connector via the ballast.

2. The tube holder as recited in claim 1, wherein the each of the first, second and third elastic pieces has an arced configuration.

3. The tube holder as recited in claim 1, wherein an opening is defined in the retainer of the first connector and extends from an external lateral surface to a sidewall thereof surrounding the through hole, and communicates with the through hole.

4. The tube holder as recited in claim 3, wherein the first connector further comprises:

a second groove defined in the retainer thereof opposite the opening; and at least one buffer pad formed on the side wall, between the opening and the second groove, the opening, the second groove, wherein the at least one buffer pad separate the first, second and third elastic pieces from each other.

5. The tube holder device as recited in claim 4, wherein a length of the third elastic is about half of a perimeter of the through hole, and lengths of the second and third elastic pieces are both about a quarter of the perimeter of the through hole.

6. The illumination device as recited in claim 5, wherein the switch is positioned next to the second elastic piece of the first connector and wherein the switch is moved from the normally closed position to be open by an activation of the second elastic piece of the first connector when the fluorescent tube is mounted to the first and second connectors at the second position.

* * * * *